US006608487B2

(12) United States Patent
De Angelis

(10) Patent No.: US 6,608,487 B2
(45) Date of Patent: Aug. 19, 2003

(54) CONTACT-CONNECTING SAFETY-MONITORED SYNTHETIC FIBER ROPES

(75) Inventor: Claudio De Angelis, Luzern (CH)

(73) Assignee: Inventio AG, Hergiswil (CH)

( * ) Notice: Subject to any disclaimer, the term of this patent is extended or adjusted under 35 U.S.C. 154(b) by 218 days.

(21) Appl. No.: 09/745,986

(22) Filed: Dec. 21, 2000

(65) Prior Publication Data

US 2001/0040039 A1 Nov. 15, 2001

(30) Foreign Application Priority Data

Dec. 21, 1999 (EP) ..... 99811186

(51) Int. Cl.[7] ..... H01H 31/02
(52) U.S. Cl. ..... 324/539; 324/542; 073/158
(58) Field of Search ..... 324/525, 539, 324/543, 512, 526, 542; 340/677; 73/158, 835, 862.391, 862.56; 187/390, 391

(56) References Cited

U.S. PATENT DOCUMENTS 5,834,942 A 11/1998 De Angelis ..... 324/539
6,289,742 B1 * 9/2001 De Angelis ..... 73/158

FOREIGN PATENT DOCUMENTS

EP 0 731 209 9/1996

* cited by examiner

*Primary Examiner*—Christine K. Oda
(74) *Attorney, Agent, or Firm*—MacMillan, Sobanski & Todd, LLC

(57) ABSTRACT

A contact-connecting device connects more than two indicator fibers in an electrically conducting manner to create a conducting connection of the indicator fibers at the end of a safety-monitored synthetic fiber rope made from electrically insulating synthetic fibers and the electrically conducting indicator fibers. A fastener fixes the contact-connecting device and the indicator fibers relative to one another, which creates a low-cost and reliable contact-connection.

14 Claims, 3 Drawing Sheets

CONTACT-CONNECTING SAFETY-MONITORED SYNTHETIC FIBER ROPES

BACKGROUND OF THE INVENTION

The present invention relates to a method of contact-connecting safety-monitored synthetic fiber ropes: it relates to suitable devices for contact-connecting as well as the safety-monitored synthetic fiber ropes themselves.

Synthetic fiber ropes are used as stationary and as running ropes for many different purposes. Used either way, they take heavy loads. In the case of running ropes, this tensile loading is complemented by flexural loading that reduces their service lifetime due to the number of load ranges in which they operate. To detect an operationally critical state of wear of the synthetic fiber ropes, their so-called replacement-readiness, in advance of failure of the synthetic fiber ropes, the safety of their condition is monitored.

Such monitoring of the safety of synthetic fiber ropes is know from the European patent specification EP 0 731 209 B1 of the applicant. Therein suspension ropes are used which consist of electrically insulating synthetic fibers, and electrically conducting indicator fibers that are relatively less strong than the insulating fibers. The indicator fibers are bundled together with the synthetic fibers to form strands. An electric voltage is applied to the indicator fibers so as to measure electrically the snapping or breaking of the indicator fibers. A disadvantage of this method of monitoring the safety of suspension ropes is its labor-intensive construction. The ends of the suspension ropes are stripped of their rope sheath, and the indicator fibers laid bare. Indicator fibers are connected in series by means of free indicator fibers of one end of a synthetic fiber rope being joined together into pairs by use of individual connecting elements. The large number of indicator fibers built into each synthetic fiber rope makes this method of construction expensive.

SUMMARY OF THE INVENTION

It is the purpose of the present invention to provide a low-cost and reliable method of contact-connecting safety-monitored synthetic fiber ropes. The method, and the workpieces used to execute the method, shall be compatible with existing standards for elevator construction.

The present invention simplifies the method described in the above-identified patent specification EP 0 731 209 for the construction of safety-monitored synthetic fiber ropes. Instead of laying bare individual electrically conducting indicator fibers of the strands of the rope ends, then electrically connecting pairs of bare indicator fibers of a rope end by means of a large number of connector sockets, and finally binding them individually with insulating material, rope ends are provided with a contact-connecting device which connects more than two indicator fibers together in an electrically conducting manner.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 3:
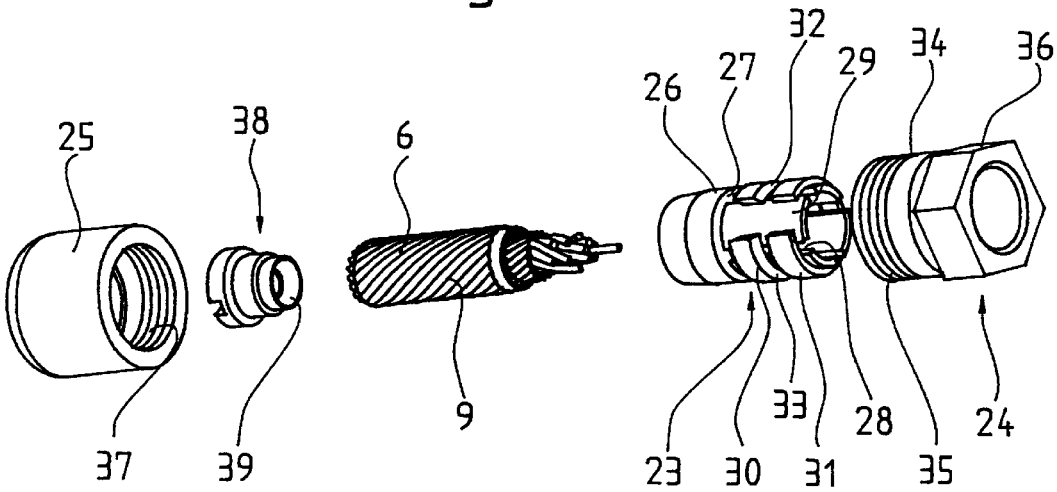
FIG. 3 is an exploded perspective view of a third embodiment of the present invention.
Figure 4:
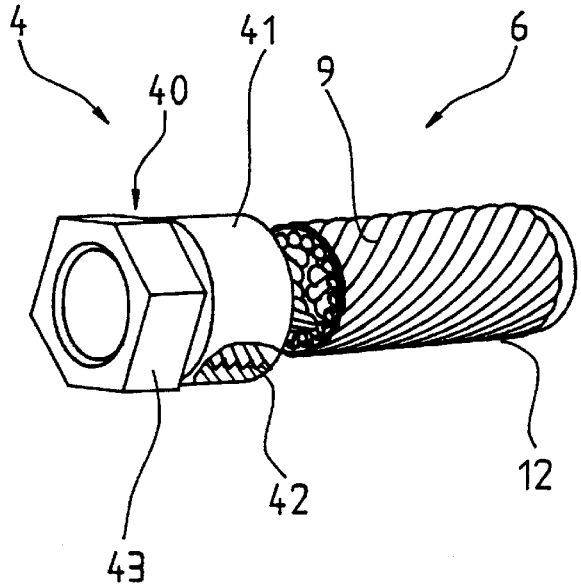
FIG. 4 is a perspective view of a fourth embodiment of the present invention in partial cutaway.
Figure 5:
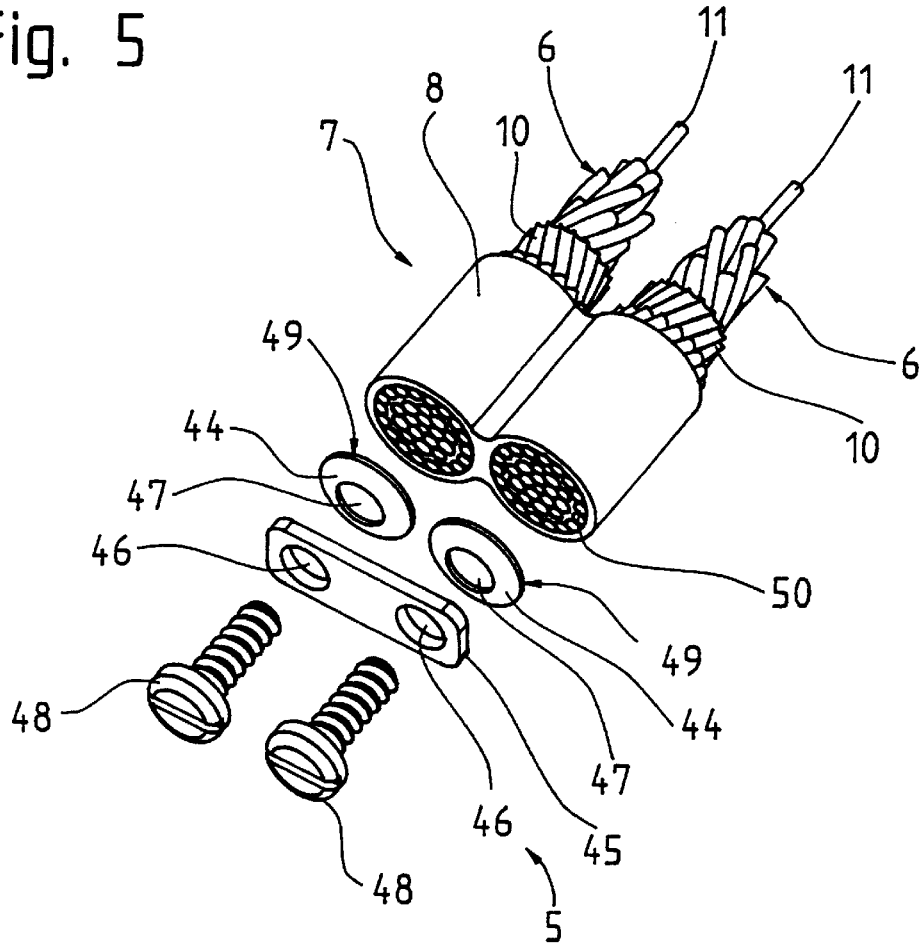
FIG. 5 is an exploded perspective view of a contact-connecting device for a safety-monitored twin rope in accordance with the present invention.

FIGS. 1 to 6 show schematically parts of exemplary embodiments of contact-connecting devices 1 through 5 and 51 for safety-monitored synthetic fiber ropes, as here, for a twisted stranded rope 6 shown in FIGS. 1 to 4 and 6, and for a so-called twin rope 7 shown in FIG. 5 comprising two stranded ropes 6 with opposite directions of twist which are combined in a non-rotating common rope sheath 8. These synthetic fiber ropes can be used in many different ways; for example, they can be used as suspension ropes for elevator installations. However, these synthetic fiber ropes can be used for other applications as, for example, a materials handling plant, aerial cableways, etc.

The stranded ropes 6 and the twin rope 7 comprise electrically insulating synthetic fibers and electrically conducting indicator fibers 9. The synthetic fibers are, for example, aramide fibers; the indicator fibers are, for example, carbon fibers. In each case, a large number of synthetic fibers, and at least one indicator fiber 9, are grouped into a strand 10. By way of example, both types of fiber, synthetic fibers and indicator fibers 9, are arranged parallel to each other and/or twisted together when the strands are manufactured. The indicator fibers 9 can, for example, be placed in the center of the strand 10 and/or, for example, run helically along a covering sheath. The latter embodiment is illustrated in exemplary manner in FIGS. 1 to 4 and 6 by means of the indicator fiber 9 separated out of the outer strand 10. The strands 10 of synthetic fibers are, for example, arranged in layers about a central core, or core strand, 11 and preferably laid together, as shown clearly by the example of the twin rope 7 in FIG. 5. A rope sheath 12 can, as shown in FIGS. 1 to 4 (the rope sheath 8 in FIG. 5), surround the stranded ropes 6 in a protective manner. The synthetic fiber ropes can be made from other synthetic fibers, and/or from other indicator fibers, as well as with other arrangements.

The indicator fibers 9 are electrically connected so as to electrically measure the snapping of the indicator fibers 9. At one end of a rope, the indicator fibers 9 are connected in series, or short-circuited, by means of one of the contact-connecting devices 1 through 5 and 51 described in greater detail below. Each of these indicator fibers 9, specifically each indicator fiber circuit, has an electrical resistance across which at the non-short-circuited end of the rope an electric voltage is applied, for example across a freely selectable indicator fiber 9 or indicator fiber circuit, and the remaining indicator fibers are tested sequentially or permanently for conductivity or magnitude of resistance by means of, for example, the monitoring device shown in the European patent specification EP 0 731 209 discussed above. When an indicator fiber 9 or an indicator fiber circuit snaps, an electric voltage applied to it breaks down which is detected and communicated to a monitor. If the number of snapped indicator fibers 9 exceeds a specified value, the monitor issues an alarm signal, for example. If the selected electrically supplying indicator fiber 9 fails, the electrical supply automatically passes to one of the other conducting indicator fibers 9. Indicator fibers in other indicator fiber circuits can be connected, for example, in combinations of series and parallel circuits.

It is advantageous for the electric voltage, as described above, to be applied at the first end of a stranded rope 6 and also measured there. For this purpose the contact-connecting device 1 through 5 and 51 at the second end of the synthetic fiber rope 6 forms an electrically conducting connection between more than two indicator fibers 9. The contact-connecting device 1 through 5 is manufactured from any electrically insulating or electrically conducting materials. In areas where it rests against ends of the indicator fibers 9 that are to be brought into electrical contact, it is electrically conducting. By contrast, the properties of the contact-connecting device 51 are essentially determined by its materials, as described below by reference to FIG. 6. The contact-connecting devices can be formed otherwise than as shown.

Essential to the invention in all these embodiments of the contact-connecting devices is that it is not individual indicator fibers 9 which are systematically assigned to, and contact-connected with, each other, but that as large a number as possible of indicator fibers come into contact with the electrically conducting part of a single contact-connecting device and are indiscriminately short circuited. Before the connection formed is put into service for monitoring, measurements are made on it and from these a reference status of the safety-monitored rope is defined. Assuming, for example, one randomly selected electrically supplying indicator fiber, the conductivity of the other indicator fibers is determined, i.e. a test is made of which indicator fibers are connected to the electrically supplying fiber. The result of the reference measurement is stored in the monitoring device and determines those indicator fibers that are to be used for rope monitoring. Instead of testing individual indicator fibers, again assuming one electrically-supplying indicator strand, the total resistance of all indicator fibers of the rope which are short-circuited by a contact-connecting device can be measured in its entirety and stored. Deviations from this reference value when monitoring the need for replacement are interpreted as snapped indicator fibers.

Figure 1:
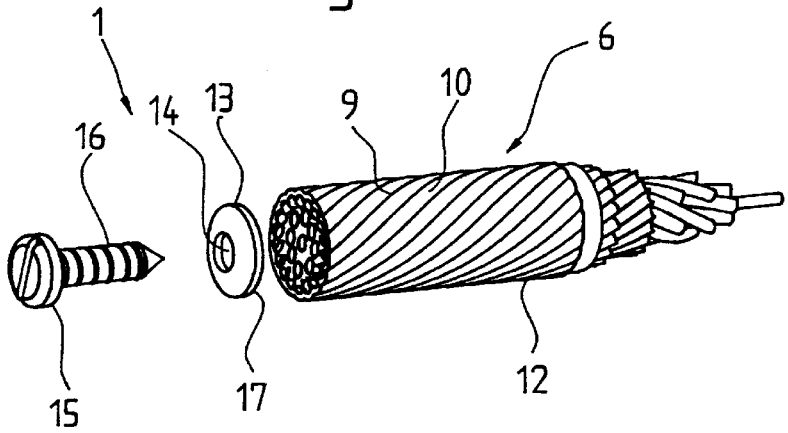
FIG. 1 is an exploded perspective view of a contact-connecting device for safety-monitored synthetic fiber ropes according to a first embodiment of the present invention.

FIG. 1 shows the contact-connecting device 1 comprising a short-circuit ring 13 with a centric round hole 14 through which a fastening screw 15 with a self-tapping thread 16 is driven into the end face of the synthetic fiber rope 6. The electrically conducting short-circuit ring 13 is domed in its own plane, and in the axial direction on the side facing the end face of the synthetic fiber rope 6 forms a contact edge 17 running around the circumferential edge. In the installed state, especially the contact edge 17 is pressed against the end faces of the strands 10 of a layer of strands and thereby comes into contact with the indicator fibers 9 bundled into the strands 10 and creates an electrically conducting connection between the indicator fibers 9. The rope sheath 12 remains on the rope end and ensures that the individual strands 10 hold together when the fastening screw 15 is screwed into the rope structure.

Figure 2:
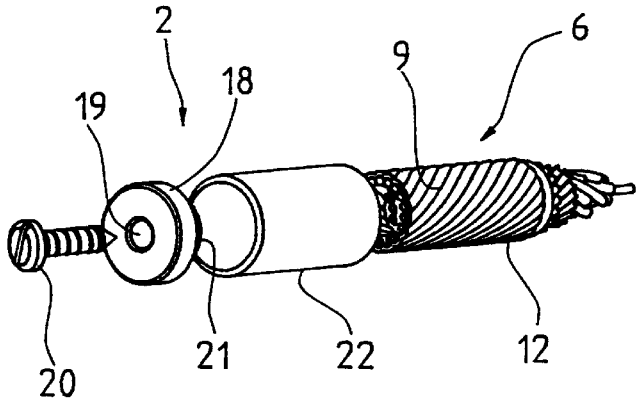
FIG. 2 is a view similar to FIG. 1 of a second embodiment of the present invention.

The contact-connecting device 2 according to FIG. 2 comprises a short-circuit ring 18 with a centric round hole 19 through which a fastening screw 20 is driven into the end face of the synthetic fiber rope 6. On its side facing the end face of the rope, the short-circuit ring 18 forms a circular, preferably sharp-edged contact edge 21. Taking the form of a hollow cylinder with its axis in the same direction as that of the screw, the contact edge 21 is driven into a layer of strands of the synthetic fiber rope 6 containing the indicator fibers 9. The short-circuit ring 18 and its contact edge 21 are formed in such manner that the contact edge 21 penetrates the strands 10 and thereby comes into contact with the indicator fibers 9. In addition to the rope sheath 12, a compression sleeve 22 is slid axially over the end of the synthetic fiber rope 6, which serves to hold the strands together as well as to create the radially directed forces in case the contact edge 21 and the fastening screw 20 should invasively work into the end face of the synthetic fiber rope 6.

The contact-connecting device 3 as illustrated in FIG. 3 can be formed on the free end of the synthetic fiber rope 6 without a tool. A compression sleeve 23 is slid coaxially over the free end of the synthetic fiber rope 6 and fastened with the aid of a threaded sleeve 24 and a threaded collar 25. The compression sleeve 23 has on its circumference a shoulder 26 which along the length of the compression sleeve 23 forms an axial stop 27. Along its length the compression sleeve 23 has, for example, three slits 28 as shown here extending to the axial stop 27 forming three legs 29. Slid coaxially onto the slit compression sleeve legs 29 are a first compression ring 30 and a second compression ring 31 that form two complementary conical surfaces 32 and 33 facing each other. The first compression ring 30 is slit in the longitudinal direction and is therefore elastic in the radial direction. The first compression ring 30 rests against the axial stop 27, whereas when the threaded sleeve 24 is threaded on axially with the axial shoulder within, it causes the second compression ring 31 to be locked against the first compression ring 30 with the result that by virtue of the conical surfaces 32 and 33 running onto each other, axially directed forces exert a centrically acting force component on the slit first compression ring and compress the slit compression sleeve 29 onto the synthetic fiber rope 6. The threaded sleeve 24 forms a tubular shaped threaded pipe 34 with an external thread 35 and has, for example, a hexagonal head 36 as shown here to take an open-end wrench, pliers, or similar to facilitate release of the contact-connecting device 3.

Complementary to the external thread 35 of the threaded sleeve 24 slid over the slit compression sleeve 29 is an internal thread 37 of the threaded collar 25 which is slid over the other axial end of the compression sleeve 23 and which is screw fastened to the threaded sleeve 24.

Here a short-circuit ring 38 with an external diameter matching the internal diameter of the threaded sleeve 25 is loosely placed coaxially in the threaded sleeve 25, and when the threaded sleeve 25 is screw fastened it is pressed against the end face of the synthetic fiber rope 6. The short-circuit ring 38 has again, as in the exemplary embodiment of the contact-connecting device 2 described above, an axially aligned ring-shaped contact edge 39 which, when the contact-connecting device 3 is screwed together, penetrates into the end face of the synthetic fiber rope 6 and forms an electrically conducting contact-connection of the indicator fibers 9.

FIG. 4 shows the contact-connecting device 4 in the form of a self-tapping short-circuit collar 40 with a short pipe 41 into whose inner wall an internal thread 42 is cut. On the external circumference of the short pipe 41 a hexagonal head 43 is formed which serves to take a tool when mounting the short-circuit collar 40 on the free end of the synthetic fiber rope 6. The internal diameter of the internal thread 42 is selected to be smaller than the diameter of the synthetic fiber rope 6 without the rope sheath 12, whereas the external diameter of the internal thread 42 corresponds approximately to the external diameter of the synthetic fiber rope including the rope sheath 12. To effect the contact-connection, the open end of the pipe 41 is placed over the free end of the synthetic fiber rope 6 and screwed onto the rope end by turning the short-circuit collar 40 about its longitudinal axis. As a result of the turning movement, the internal thread 42 cuts into the rope sheath 12, the short-circuit collar 40 thereby coming into contact with the outermost layer of strands and the indicator fibers 9 running in it, which it short circuits.

The embodiment of the contact-connecting device 5 according to FIG. 5 serves to form a short circuit of the indicator fibers 9 of the so-called twin rope 7. The twin rope 7 comprises two stranded ropes 6 with opposite directions of lay which are non-rotatingly fixed in their position parallel to each other and combined to form the twin rope 7 by the common rope sheath 3. Each end face of the two stranded ropes 6 is connected in an electrically conducting manner and short circuited by a short-circuit ring 44, and the short-circuit rings 44 are connected to each other in an electrically conducting manner by a bridge connector 45. The bridge connector 45 has two round holes 46 made through it which are spaced by the distance between the longitudinal rope axes of the stranded ropes 6. The short-circuit rings 44 and the bridge connector 45 are held axially behind each other and under pressure against the end faces of the twin rope 7 with the assistance of two fastening screws 48 passing through round holes 47 in the rings 44. The fastening screws 48, taking the form, for example, of slotted-head screws, cut into interior layers of strands of the two stranded ropes 6 of the twin rope 7 and thereby hold contact edges 49 of the short-circuit rings 44 against the strands 10 of a covering layer 50 which contains the indicator fibers 9.

For the purpose of monitoring the need for replacement due to wear of the twin rope 7 in an elevator installation, the short-circuit rings 44 on the counterweight end, for example, of the twin rope 7 serving as suspension rope are connected together in an electrically conducting manner as described. At the car end of the twin rope 7 the monitoring voltage is then supplied to one of the two stranded ropes 6. On the other stranded rope 6 of the twin rope 7, at the same end of the stranded ropes 6 which are connected together in series by means of the contact-connecting device 5, the overall resistance, for example, of the indicator fibers 9 or indicator fiber circuit is measured. In this manner, given a specified increase in the electrical resistance, it can be concluded that either one or several indicator fibers 9 have failed. When a certain rate of failure is exceeded, this indicates that the twin rope 7 must be replaced.

There are a great variety of other ways of realizing the fastening means of the contact-connecting device according to the present invention. For instance, fastening a short-circuit element onto the end of a synthetic fiber rope by bonding with adhesive or pressing is also possible.

Figure 6:
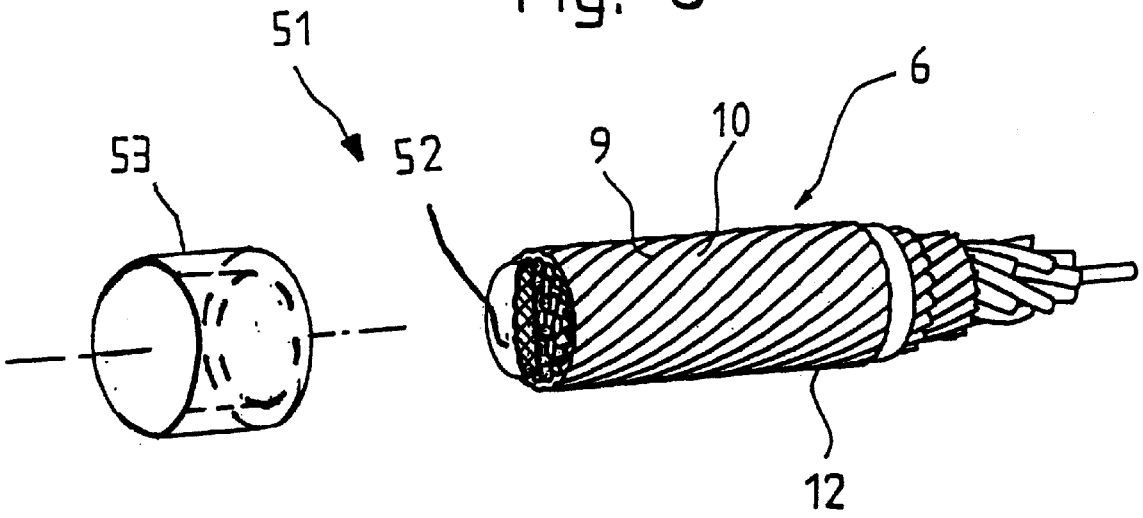
FIG. 6 diagrammatically a part of a fifth exemplary embodiment of a contact-connecting device for safety-monitored synthetic fiber ropes in the form of an electrically conducting layer of adhesive.

FIG. 6 illustrates an embodiment of the contact-connecting device 51, which takes the form of a layer of adhesive 52 made from an electrically conducting adhesive. The layer of adhesive 52 preferably consists of an acrylic resin or epoxy resin with which an electrically conducting filler is admixed. Examples of adhesives used here are the silver-filled electrically conducting single component coating agents commercially designated ELECOLIT 342 and ELECOLIT 489 with the company PANACOL-ELOSOL GmbH. ELECOLIT 342 is a silver-filled acrylic resin with an electrical resistivity of 0.01–0.001 ohm-cm. ELECOLIT 489 is an epoxy resin filled with a silver alloy and contains a correspondingly low proportion of silver; its electrical resistivity of 0.01 ohm-cm. ELECOLIT 342 and ELECOLIT 489 are therefore especially suitable for making electrically conducting connections.

Creating end contacts by means of electrically conducting adhesive is simple and fast. The electrically conducting adhesive can be applied to the end face of the rope end of the synthetic fiber rope 6 or of the twin rope 7 with a brush and dries at room temperature, thereby forming a hard, visco-elastic layer of adhesive 52. In contrast to conventional short-circuiting by means of clips or mechanical connecting elements, the quality of the cut surface of the rope has, over a wide range, no influence on the reliable contacting of the indicator fibers 9. Applied as a liquid, the electrically conducting adhesive penetrates into the interstices between the strands 10, and thereby compensates for differences in length of the indicator strand ends of the end face of the rope end of the synthetic fiber rope 6. At the same time, after the layer of adhesive 52 has hardened, it is firmly anchored in the rope end of the synthetic fiber rope 6.

As shown in FIG. 6, a rubber elastic sleeve 53, for example, can be slid over the rope end of the synthetic fiber rope 6, which protects the layer of adhesive 52 from mechanical wear.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for contact-connecting a safety-monitored rope comprsing the steps of:

a. providing a rope having at least one strand constructed from a first plurality of electrically insulating synthetic fibers and a second plurality of electrically conducting indicator fibers, at least Flee of the indicator fibers extending to an end of the rope; and b. connecting the at least three indicator fibers together in an electrically conducting manner with a contacting element fastened to the end of the rope.

2. The method according to claim 1 including a step of measuring a resistance value of the connected at least three indicator fibers and storing the resistance value as a reference value.

3. A synthetic fiber rope comprising:

a first plurality of electrically insulating synthetic fibers twisted together to form a twisted stranded rope;

a second plurality of electrically conducting indicator fibers arranged parallel to and twisted together with said insulating fibers, at least three of said indicator fibers extending to an end of said rope; and a contacting means attached to said end of said rope for connecting said at least three of said indicator fibers together in an electrically conducting manner.

4. The rope according to claim 3 including a fastening means for attaching said contacting means to said end of said rope and for connecting said at least three of said indicator fibers in the electrically conducting manner.

5. The rope according to claim 4 wherein said contacting means is attached to an end face of said end of said rope by said fastening means.

6. The rope according to claim 4 wherein said fastening means includes a self-tapping screw.

7. The rope according to claim 4 wherein said fastening means includes a compression sleeve aid collar.

8. The rope according to claim 3 wherein said contacting means is formed as a ring.

9. The rope according to claim 3 wherein said contacting means is an electrically conducting layer of adhesive applied to said end of said rope.

10. The rope according to claim 9 including an elastically ductile sleeve attached to said end of said rope and covering said electrically conducting layer of adhesive.

11. A safety-monitored synthetic fiber rope comprising:

a plurality of strands of twisted together electrically insulating synthetic fibers and electrically conducting indicator fibers; and a contact-connecting device attached to an end of the rope in electrically conducing contact with more than two of said indicator fibers.

12. The rope according to claim 11 formed as a suspension rope for use in an elevator installation.

13. The rope according to claim 11 wherein said plurality of stands forms a first rope and including another plurality of strands of twisted together electrically insulating synthetic fibers and electrically conducting indicator fibers forming a second rope, said first and second ropes being fixed parallel to catch other by a common rope sheath, said contact-connecting device extending between and being attached to said end of said first rope and an end of said second rope to electrically short-circuit said indicator fibers of said first and second ropes with each other.

14. The rope according to claim 13 formed as a suspension rope for use in an elevator installation.

* * * * *